United States Patent [19]

Governale

[11] 4,118,895

[45] Oct. 10, 1978

[54] LINER FOR INTERSECTING CROSS BORE AND EDGE BORE OF FOAM-FILLED METAL SKINNED DOOR

[75] Inventor: Bernard C. Governale, Duluth, Ga.

[73] Assignee: Peachtree Doors, Inc., Norcross, Ga.

[21] Appl. No.: 863,909

[22] Filed: Dec. 23, 1977

[51] Int. Cl.[2] ..... E06B 3/00

[52] U.S. Cl. ..... 49/503; 52/743

[58] Field of Search ..... 52/743, 615, 309.16; 49/503, 501, 399, 167

[56] References Cited

U.S. PATENT DOCUMENTS

| | | | |
|---|---|---|---|
| 2,924,861 | 2/1960 | Viets | 49/399 |
| 3,156,019 | 11/1964 | Dawley | 49/167 X |
| 3,334,464 | 8/1967 | Charles | 49/501 X |
| 3,512,305 | 5/1970 | Multer | 49/503 |

*Primary Examiner*—Kenneth Downey
*Attorney, Agent, or Firm*—D. Paul Weaver

[57] ABSTRACT

Prior to foaming, a unitary molded plastic liner or dam for the lockset cross bore and edge bore of a foam-filled metal skinned insulated door is installed between the metal skins in registration with accurately located pre-punched skin openings. The edge bore lining extension of the device is inserted into a preformed opening of the wooden stile for positioning the device. The device prevents insulating foam from entering the cross bore or intersecting edge bore in the subsequent foaming operation. Significant reinforcement is also provided between the metal skins of the door to prevent buckling of the skins during the installation of door hardware.

7 Claims, 5 Drawing Figures

LINER FOR INTERSECTING CROSS BORE AND EDGE BORE OF FOAM-FILLED METAL SKINNED DOOR

BACKGROUND OF THE INVENTION

In the prior art, it has been customary for the carpenter on the job site to form the intersecting lockset cross bore and bolt receiving edge bore in the door panel at the desired height above the floor and with the cross bore at a precise distance from the swinging edge of the door. Without this precision, the components of the lockset will not be properly received and the lock will not operate properly. This customary precedure in the field has required the carpenter to utilize expensive boring jibs and special size drilling bits.

The problem becomes more difficult when the cross bore and edge bore must be formed in a metal clad or metal skinned foam-filled door utilizing 24 gauge steel sheets for the opposite side skins.

The present invention has been devised to deal with and simplify the above prior art problems incident to the formation of lockset cross bores and edge bores in doors. In the invention, the door metal skins are accurately prepunched in the manufacturing process to establish a well located cross bore axis and a very clean appearance. At an appropriate time in the manufacturing process of the door, the required bolt receiving edge bore is formed accurately in the wooden stile at the swinging edge of the door in proper intersecting relationship with the axis of the larger cross bore. In a more primative state of development of the invention, a cardboard sleeve or dam was inserted between the metal skins to block the flow of urethane foam into and through the bores during the subsequent foaming procedure.

In the completed invention according to the present application the cardboard sleeve or dam is eliminated along with the necessity for drilling the stile edge bore through this sleeve for proper lock installation. Instead, after formation of the punched openings in the metal skins and the intersecting edge bore in the stile, a single unitary molded plastic liner or dam for both intersecting bores is installed prior to the final assembly and foaming operations, this liner having accurate dimensions for registration with the punched openings of the metal skins and for snug entry into the edge bore of the wooden stile. The liner or dam which is molded from plastic has integral annular sealing lips at the opposite ends of its cross bore portion to effectively seal with the interior faces of the metal skins so that no foam can enter or pass through either of the critical right angular bores of the liner which intersect and are in open communication. No drilling or cutting of the liner is required as was the case with the primative cardboard sleeve and no job site drilling of doors by carpenters with expensive jigs and tools is required by virtue of the invention. Economy is greatly enhanced as well as convenience both in the manufacturing of doors and in their installation compared to the prior art practices.

Another major benefit of the invention is that the main cross bore sleeve abuts the opposite side sheet metal door skins and reinforces them against buckling during the installation of the lock hardware.

Examples of the patented prior art are shown in the following U.S. patents: U.S. Pat. No. 2,924,861 U.S. Pat. No. 3,039,291 U.S. Pat. No. 3,060,523 U.S. Pat. No. 3,287,855 U.S. Pat. No. 3,359,699 U.S. Pat. No. 3,455,078 U.S. Pat. No. 3,512,305 U.S. Pat. No. 3,987,600 U.S. Pat. No. 4,044,511.

DETAILED DESCRIPTION

Figure 1:
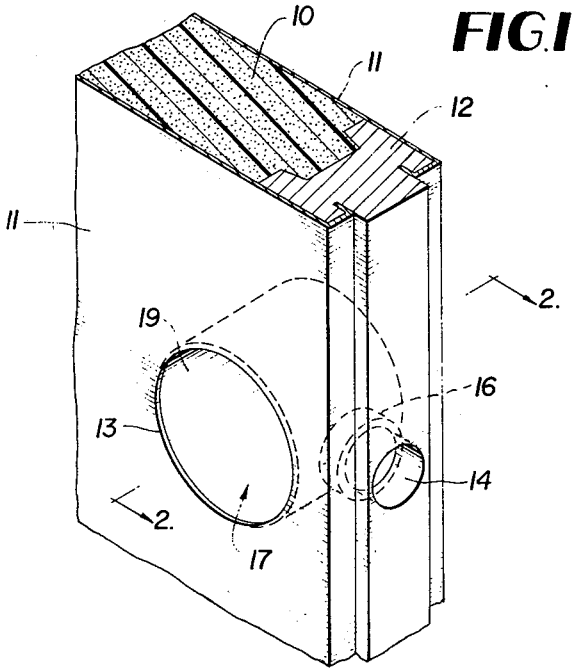
FIG. 1 is a fragmentary perspective view, partly in cross section, showing the invention installed in a foam-filled metal skinned door.

Referring to the drawings in detail, wherein like numerals designate like parts, there is illustrated in FIG. 1 an insulated door having a core 10 of urethane foam or the like, bonded opposite side steel skins 11 preferably formed of 24 gauge steel, and a swinging edge vertical wood stile 12 of conventional construction.

In the manufacturing of the door panel, at an appropriate time prior to assembly and foaming, the two skins 11 are punched to form accurately aligned equal size circular openings 13 whose common horizontal axis is normal to the plane of the door and spaced a precise distance from the edge plane of the stile 12, such as 2¾inches. It may be noted here that a novel feature of the invention is that the one-piece molded plastic liner can be utilized where the critical distance from the axis of the cross bore to the swinging edge of the door is 2¾inches or 2⅜inches.

Figure 3:
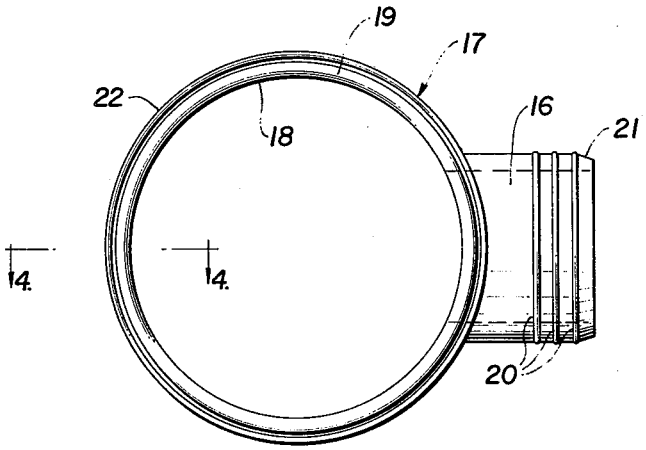
FIG. 3 is a side elevational view of the unitary plastic liner or dam forming the principal subject matter of the invention.

Also in the manufacturing process, the stile 12 has an edge bore 14 formed therein in right angular intersecting relationship to the axis of punched openings 13 and the stile is also counterboard on its interior side at 15 for the snug reception of the edge bore extension or sleeve 16 of the one-piece molded plastic liner 17, FIG. 3, forming the main feature of the invention.

Figure 2:
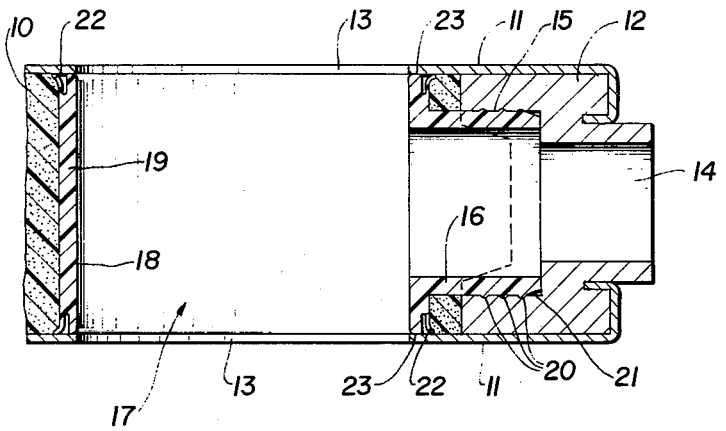
FIG. 2 is an enlarged horizontal section taken on line 2—2 of FIG. 1.

The liner or dam 17 is installed between the two skins 11 prior to the foaming operation and the liner is held and positioned snugly between the metal skins 11 with its cross bore 18 in accurate registration with the two punched openings 13, FIG. 2. The larger cross bore sleeve portion 19 of the liner 17 is cylindrical and the smaller diameter edge bore lining sleeve or extension 16 is also cylindrical and preferably ribbed on its exterior as at 20 to assure snug holding and sealing engagement within the counterbore 15 of the stile. This snug engagement aids in holding the entire liner 17 fixedly during the foaming operation. The bores of the two sleeves 19 and 16 intersect at right angles, as illustrated. The leading end of the sleeve 16 is tapered at 21 for ease of entry into the stile counterbore 15.

Figure 4:
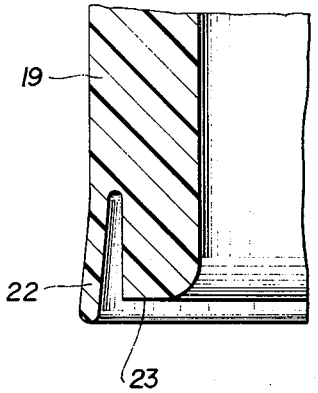
FIG. 4 is a greatly enlarged fragmentary cross section taken through one end of the liner and showing an integral seal in the relaxed non-use state.
Figure 5:
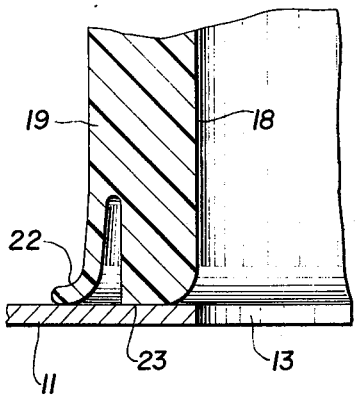
FIG. 5 is a similar cross section showing the same seal during active use.

A feature of the invention is the provision on each end of the cross bore sleeve 19 of an integral comparatively thin flexible annular seal 22 which, in the relaxed state, FIG. 4, extends somewhat forwardly of the rigid end face 23 of the sleeve. In the assembled device, FIGS. 2 and 5, the end faces 23 abut the interior faces of the metal skins 11 and the elastic seals 22 deflect outwardly as shown in FIG. 5 and are thus tensioned into positive sealing contact with the skins 11. Consequently, during the subsequent foaming of the assembled door after placement of the liner or dam 17 to produce the core 10, the foam is prevented from entering either the cross bore or edge bore where such foam would interfere with proper installation of the lockset.

Additionally, the sleeve 19 which is quite rigid and has its ends in abutment with the metal skins 11 greatly reinforces these skins in the region of the openings 13 and prevents buckling of the skins during the installation of lock hardware, as might otherwise occur if the installer of the hardware exerts too much pressure.

The invention is characterized by extreme simplicity. It renders the manufacturing process and the door installation process less expensive and much more convenient. Greater accuracy in terms of critical dimensions is achieved on a consistent basis and the product is rendered more neat and attractive in appearance. The advantages of the invention should now be apparent to the skilled artisan.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. In a foam-filled door having opposite side metal skins and a swinging edge stile connected with the skins, said skins having axially aligned cross bore openings spaced a precise distance from the outer edge face of said stile and said stile having an edge bore intersecting the common axis of said cross bore openings at right angles, a one-piece liner and dam having a relatively large diameter cross bore sleeve portion mounted between said skins with its bore in registration with said cross bore openings of the skins and having a smaller diameter edge bore sleeve projecting radially of the cross bore sleeve portion and engaged snugly within the edge bore of the stile, the opposite end faces of the cross bore sleeve portion of said liner engaging the interior faces of said metal skins, the installed liner blocking the passage of foam into said cross bore and edge bore.

2. In a foam-filled door as defined in claim 1, and said one-piece liner molded as a unit from plastics material.

3. In a foam-filled door as defined in claim 2, and integral annular flexible seals carried by opposite ends of the cross bore sleeve portion and sealingly engaging the interior faces of said skins, said seals in a relaxed state projecting forwardly of the end faces of the cross bore sleeve portion and said seals yielding outwardly and being tensioned while in active sealing engagement with the skins and while said end faces are in positive contact with the skins.

4. In a foam-filled door as defined in claim 3, and said seals disposed outwardly of said end faces in surrounding relation thereto.

5. In a foam-filled door as defined in claim 2, and said smaller diameter edge bore sleeve being externally ribbed to promote snug engagement in the edge bore of said stile.

6. In a foam-filled door as defined in claim 2, and the edge bore of said stile including an interior side enlarged counterbore receiving said smaller diameter edge bore sleeve with the leading end of such sleeve abutting the forward end wall of said enlarged counterbore.

7. A unitary molded plastics liner and reinforcer for the cross bore and edge bore of a foam-filled metal skinned door having a swinging edge stile, said stile provided with an edge bore and the metal skins of the door having aligned cross bore openings, said unitary liner and reinforcer comprising a relatively large diameter cylindrical cross bore sleeve portion including end faces and flexible annular seal elements integral therewith and surrounding the end faces, said liner and reinforcer including a relatively small diameter cylindrical radial edge bore sleeve intersecting the cross bore sleeve portion at right angles, the cross bore sleeve adapted to enter the edge bore of a stile and the cross bore sleeve portion adapted for placement between metal skins of a foam-filled door with said seal elements engaging the inner faces of metal skins.

* * * * *